US006024625A

United States Patent [19]

Pearce

[11] Patent Number: 6,024,625

[45] Date of Patent: Feb. 15, 2000

[54] MUSICAL BABY BOTTLE

[75] Inventor: Walter Pearce, Newport, United Kingdom

[73] Assignee: Textformat Limited, United Kingdom

[21] Appl. No.: 09/126,518

[22] Filed: Jul. 30, 1998

[51] Int. Cl.[7] ..... A63H 5/00; A63H 29/10; A61J 9/00; G06M 7/00

[52] U.S. Cl. ..... 446/81; 446/175; 215/11.1; 215/378; 250/221

[58] Field of Search ..... 446/81, 175, 267, 446/219; 215/11.1, 11.6, 378; 200/181, 61.02; 250/221

[56] References Cited

U.S. PATENT DOCUMENTS

| | | | |
|---|---|---|---|
| 3,627,161 | 12/1971 | Wergeland . | |
| 4,033,453 | 7/1977 | Giamo | 215/11.1 |
| 4,184,072 | 1/1980 | Sanford et al. | 250/231 |
| 4,209,735 | 6/1980 | Yoshida | 136/291 X |
| 4,369,498 | 1/1983 | Schulte | 136/291 X |
| 4,678,093 | 7/1987 | Allen . | |
| 4,944,704 | 7/1990 | Grace | 446/74 |
| 5,382,204 | 1/1995 | Green | 136/291 X |
| 5,489,893 | 2/1996 | Jo et al. | 215/11.1 X |
| 5,664,745 | 9/1997 | Hadaway | 215/11.1 X |
| 5,668,333 | 9/1997 | Horton et al. | 446/175 X |
| 5,842,901 | 12/1998 | Montgomery | 446/81 X |

FOREIGN PATENT DOCUMENTS

| | | | |
|---|---|---|---|
| 2185898 | 8/1987 | United Kingdom | 446/175 |

*Primary Examiner*—D Neal Muir
*Attorney, Agent, or Firm*—Tim Headley; Haynes and Boone, LLP

[57] ABSTRACT

A musical feeding bottle for babies comprises a hollow body 10 for holding the baby's feed and a sound generating assembly having an electrically operated sound generating device 11,12 sealingly mounted therein. The sound generating device 11,12 is activated when the amount of light incident on a photodiode thereof exceeds a predetermined level. A shutter 21 is provided for obscuring light from the photodiode, when it is desired to deactivate the sound generating device 11,12. The shutter enables the device 11,12 to be activated and deactivated simply and remotely, without any physical connection to the device that could allow the ingress of liquid or steam liquid when the device is being washed or sterilised.

6 Claims, 2 Drawing Sheets

MUSICAL BABY BOTTLE

BACKGROUND OF THE INVENTION

1. Field of the Invention

This invention relates to a musical feeding bottle for a baby.

2. Related Background Art

Musical baby feeding bottles are well known. Typically, such known musical baby bottles comprise a container for holding liquid and an electrically or mechanically operated music generating device. It is important to wash and sterilise babies feeding bottles, however, a disadvantage of this is that emersion in water and steam or sterilising fluid can damage the music generating device.

U.S. Pat. No. 4,678,093 discloses a musical baby bottle comprising a container having an electrically operated music generated device sealed in its base. The device is activated by means of a mercury tilt switch, thereby obviating any need to have an external switch which may let in water or moisture.

A disadvantage of mercury tilt switches is that mercury is poisonous and furthermore the music generating device will only remain active as long as the baby is moving, which is not always the case when the baby is feeding. Another disadvantage is that it is not possible to turn the device off, say whilst the bottle is being carried in a bag and thus music can be played at undesirable times, which is both embarrassing and annoying.

We have now devised a musical baby bottle that alleviates the above mentioned problems.

SUMMARY OF THE INVENTION

In accordance with this invention, there is provided a musical baby's feeding bottle comprising a hollow body for holding the baby's feed and a sound generating assembly having an electrically operated sound generating device sealingly mounted therein, said device having light sensitive activation means directed through a transparent wall of assembly, the bottle further comprising shutter means on the opposite side of said wall for moving between first and second positions in which the amount of light incident on the activation means is different.

The music generating device is sealingly mounted in the assembly and thus water etc. is unable to come into contact with the device. However, the device can be remotely activated and deactivated by moving the shutter between the first and second position, thereby varying the amount of light incident on the light sensitive activation means.

The shutter can be left in the first or second positions so that the device is permanently activated or deactivated.

Preferably the sound generating device is activated when the amount of light incident on the activation means is above a predetermined level and deactivated when the amount of light is below a predetermined level.

In one embodiment, the assembly is permanently attached to the body of the bottle, thereby alleviating the risk that it may get lost or forgotten.

In this embodiment, the sound generating device and activation means may be sealingly mounted inside a housing which is permanently fitted to the underside of the body of the bottle.

Alternatively, the sound generating device and activation means may be sealingly mounted inside the hollow body of the bottle, preferably adjacent a bottom wall thereof.

Alternatively, the sound generating device and activation means may be sealingly mounted in a recess formed in a bottom wall of the body of the bottle.

In an alternative embodiment, the assembly is detachable from the body of the bottle, so that if desired, it can be removed whilst the body of the bottle is being washed or sterilised.

Preferably the assembly is disposed at the base of the body of the bottle, the activation means being directed through a transparent wall which faces downwardly when the bottle is stood in an upright position.

Thus, the device can also be activated and deactivated when the bottle is picked up and set down.

In one embodiment, the shutter means is detachable from the assembly, the shutter means comprising means for engaging the assembly. The shutter means may comprise a cap which engages with the assembly, say by means of a push or screw fitting.

In an alternative embodiment, the shutter means is slidably or rotatably mounted to the assembly.

BRIEF DESCRIPTION OF THE DRAWINGS

Embodiments of this invention will now be described by way of examples only and with reference to the accompanying drawings, in which.

DETAILED DESCRIPTION OF THE PREFERRED EMBODIMENTS

Figure 1:
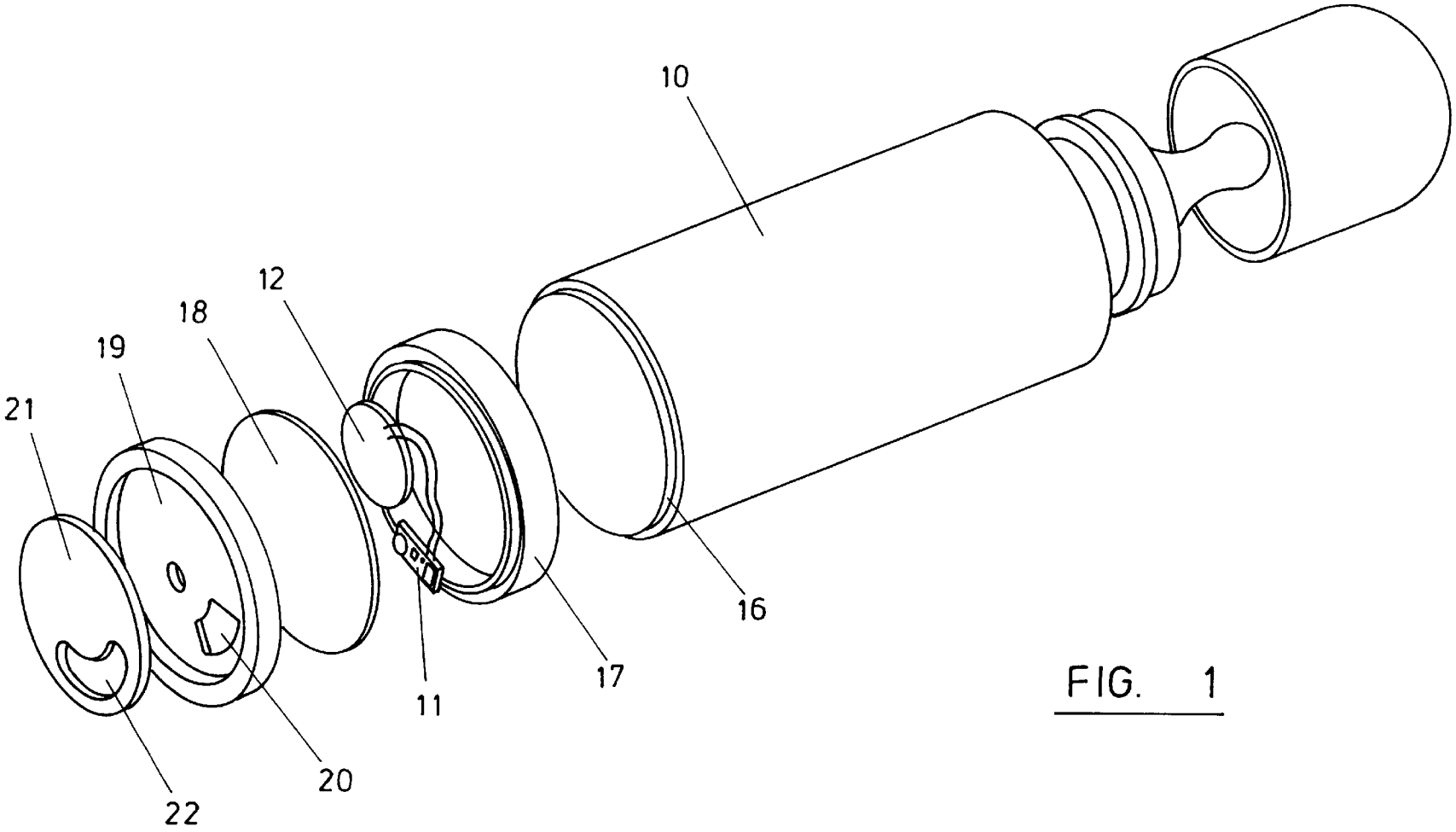
FIG. 1 is an exploded view in perspective of an embodiment of musical baby's bottle in accordance with this invention.

Referring to FIG. 1 of the drawings, there is shown a musical baby's bottle comprising a conventional bottle-shaped body portion 10 formed of plastics material having a sound generating assembly fitted to its underside.

The sound generating assembly comprises an electrically-operated sound generating device of the type used in novelty greetings cards having a printed circuit board 11 including an integral photodiode, and a piezo-electric loudspeaker 12 attached to the printed circuit board 11 by wires. In use, the photodiode activates the device in the event that the amount of light that is incident thereon exceeds a predetermined level.

The sound generating device is mounted in a recess formed in the underside of a circular plastics housing 17 of the assembly, which is arranged to snap-engage with a lip 16 that extends around the underside of the body of the bottle 10. The external diameter of the housing 17 corresponds with the external diameter of the body of the bottle 10. A circular window 18 of transparent plastics material is fitted to the underside of the housing, in order to seal the sound generating device in the recess. Alternatively, the recess in the housing 17 may be filled with a transparent thermosetting plastics material 14 which encapsulates the sound generating device.

The printed circuit board 11 is mounted such that the photodiode thereon is directed downwardly through the transparent window 18.

A circular cover 19 for the housing is snap engaged to the underside of the housing 17. The cover 19 comprises an aperture 20, which is disposed in line with the photodiode.

A disc 21 is rotatably mounted in a circular recess formed in the underside of the cover 19. An arcuate aperture 22 is formed in the disc 21 at a point radially outward of its centre.

The sound generating device can be activated by rotating the disc 21 to a position in which its aperture 22 is aligned with the aperture 20 in the cover 19 and with the photodiode, thereby allowing light to reach the photodiode through the aligned apertures 20,22.

The device 11 emits music, such as a lullaby, when it is activated and we have found that this helps to get babies off to sleep more quickly. The device is deactivated by rotating the disc 21 to a position in which it obscures the photodiode. Alternatively, the device 11 can be deactivated by standing the bottle on a surface, such that light is shielded from the photodiode. The disc 21 can be rotated to the position in which it obscures the photodiode, whilst the bottle is being carried away from the home, in order to prevent music from being played and to preserve the battery.

The assembly can be detached from the body 10 of the bottle, whilst the latter is being washed and sterilised, in order to prevent music from being played and in order to prevent the assembly from being damaged by the sterilising liquid or steam.

Figure 2:
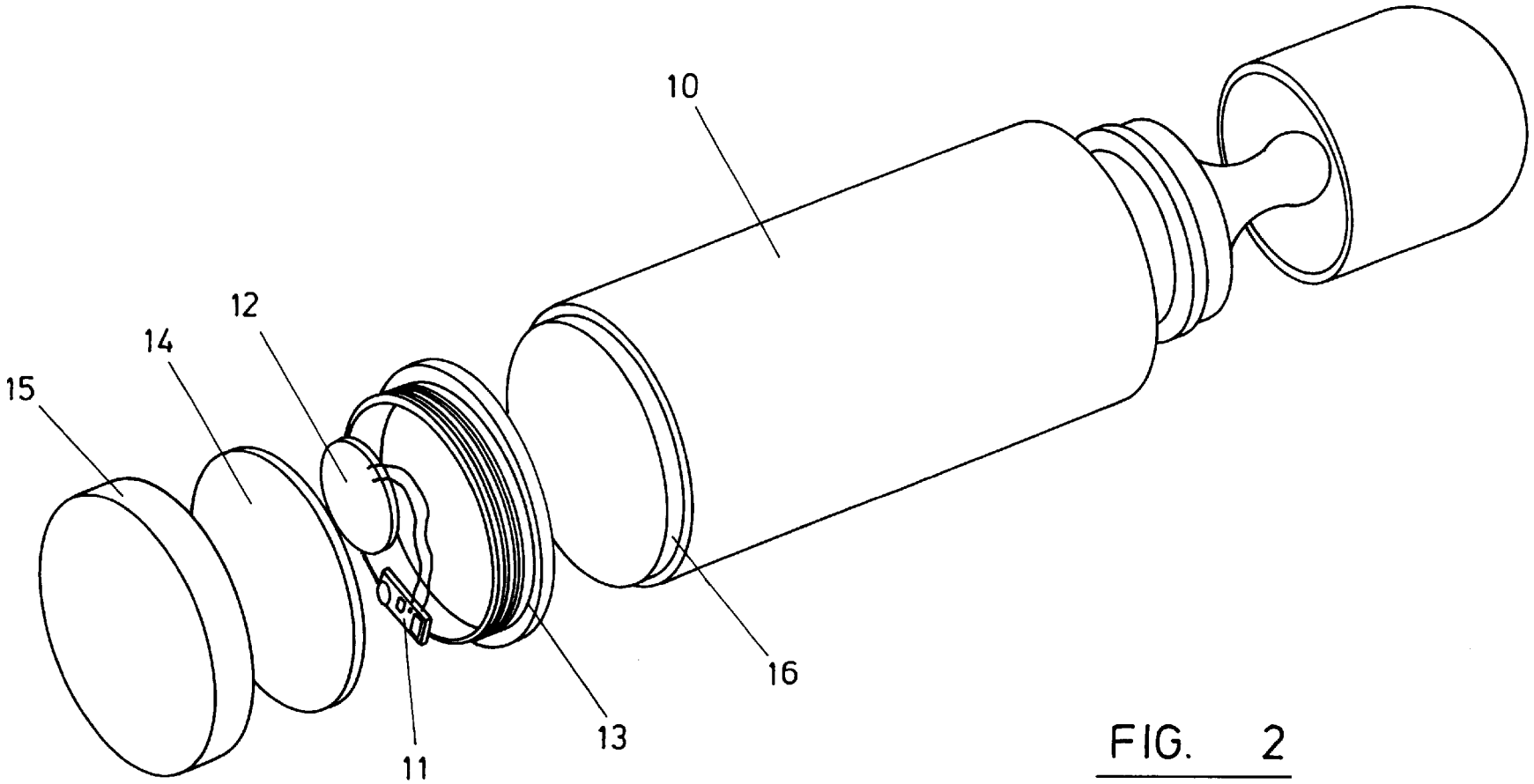
FIG. 2 is an exploded view in perspective of an alternative embodiment of musical baby's bottle in accordance with this invention.

Referring to FIG. 2 of the drawings, there is shown an alternative embodiment of musical baby's bottle and like parts are given like reference numerals. The bottle again comprises a conventional bottle-shaped body portion 10 formed of plastics material having a sound generating assembly fitted to its underside.

The sound generating assembly comprises a similar sound generating device mounted inside a recess formed in the underside of a plastics housing 13 of the assembly, which is arranged to snap-engage with a lip 16 that extends around the underside of the body of the bottle 10. A circular window 14 of transparent plastics material seals the sound generating device in the recess of the housing 13. The sound generating device is mounted such that the photodiode thereon is directed downwardly through the window 14.

The housing 13 of the assembly is externally screw-threaded and an internally screw-threaded cap 15 of opaque plastics material is provided for fitting to the housing 13, in order to obscure the window 14.

The cap 15 is normally screwed to the housing 13, when the bottle is not in use. The cap 15 is opaque and thereby light is prevented from illuminating the photodiode. The sound generating device can be activated by unscrewing the cap 15, so that light illuminates the photodiode 12 through the window 14 in the bottom of the housing 13.

The device can be deactivated either by standing the bottle on a surface, such that light is shielded from the photodiode or by refitting the cap 15.

The assembly can again be detached from the body 10 of the bottle, whilst the latter is being washed and sterilised.

I claim:

1. A musical feeding bottle for babies comprising a hollow body for holding the baby's feed and a sound generating assembly having an electrically operated sound generating device sealingly mounted therein, said device having light sensitive activation means directed through a transparent wall of assembly, the bottle further comprising shutter means on the opposite side of said wall for moving between first and second positions in which the amount of light incident on the activation means is different.

2. A musical feeding bottle for babies as claimed in claim 1, in which the assembly is detachable from the body of the bottle.

3. A musical feeding bottle for babies as claimed in claim 2, in which the assembly is disposed at the base of the body of the bottle, the activation means being directed through a transparent wall which faces downwardly when the bottle is stood in an upright position.

4. A musical feeding bottle for babies as claimed in claim 1, in which the shutter means is detachable from the assembly, the shutter means comprising means for engaging the assembly.

5. A musical feeding bottle for babies as claimed in claim 1, in which the shutter means is slidably mounted to the assembly.

6. A musical feeding bottle for babies as claimed in claim 1, in which the shutter means is rotatably mounted to the assembly.

* * * * *